US005975577A

United States Patent [19]

Gottdiener

[11] Patent Number: 5,975,577

[45] Date of Patent: Nov. 2, 1999

[54] SAMPLE BOOK BINDING SYSTEM

[75] Inventor: Gary S. Gottdiener, Westfield, N.J.

[73] Assignee: International Service Group, LLC, Elizabeth, N.J.

[21] Appl. No.: 08/845,010

[22] Filed: Apr. 22, 1997

[51] Int. Cl.[6] ..... B42D 1/08; B42D 3/06

[52] U.S. Cl. ..... 281/21.1; 281/15.1; 281/36; 281/38; 281/46; 281/28; 281/47

[58] Field of Search ..... 281/21.1, 15.1, 281/36, 28, 38, 46, 47

[56] References Cited

U.S. PATENT DOCUMENTS

| | | | |
|---|---|---|---|
| 922,605 | 5/1909 | Lenehan | 16/169 |
| 1,722,812 | 7/1929 | Martin . | |
| 1,792,740 | 2/1931 | Hayden . | |
| 2,164,659 | 7/1939 | McChesney et al. . | |
| 2,228,891 | 1/1941 | Wedge . | |
| 2,338,891 | 1/1944 | Auburn . | |
| 2,734,223 | 2/1956 | Park . | |
| 2,891,553 | 6/1959 | Acton . | |
| 3,188,686 | 6/1965 | Orcutt . | |
| 3,793,758 | 2/1974 | Feldhusen et al. . | |
| 4,180,341 | 12/1979 | Langhorst . | |
| 4,455,711 | 6/1984 | Anderson . | |
| 4,475,266 | 10/1984 | Suska . | |
| 4,498,828 | 2/1985 | Ackerman . | |
| 4,601,489 | 7/1986 | Stancato . | |
| 4,683,613 | 8/1987 | Starke . | |
| 4,821,374 | 4/1989 | Gavagan . | |
| 4,831,655 | 5/1989 | Buettner . | |
| 4,896,900 | 1/1990 | Hong | 281/15.1 |
| 4,934,739 | 6/1990 | Stancato . | |
| 4,949,997 | 8/1990 | Champagne . | |
| 5,031,936 | 7/1991 | Vannier | 281/15.1 |
| 5,056,823 | 10/1991 | Stancato . | |
| 5,104,147 | 4/1992 | King . | |
| 5,174,674 | 12/1992 | Norwood . | |

FOREIGN PATENT DOCUMENTS

| | | |
|---|---|---|
| 0 281 434 | 9/1988 | European Pat. Off. . |
| 165974 | 6/1971 | Netherlands . |

*Primary Examiner*—Willmon Fridie, Jr.
*Assistant Examiner*—Mark T. Henderson
*Attorney, Agent, or Firm*—Lerner, David, Littenberg, Krumholz & Mentlik, LLP

[57] ABSTRACT

A sample book binding system for retaining a plurality of sample sheets includes a plurality of rotatably interlocked sheet holding members arranged in side by side relationship. The sheet holding members are provided with a plurality of linking segments which are interdigitated to provide an aligned axial bore for receiving a pintle. At least two adjacent linking segments are spaced apart to provide an opening which captures a deformed section of the pintle for releasably locking the pintle within the linking segment. The removal and insertion of additional sheet holding members may be accomplished upon removal of the pintle.

47 Claims, 5 Drawing Sheets

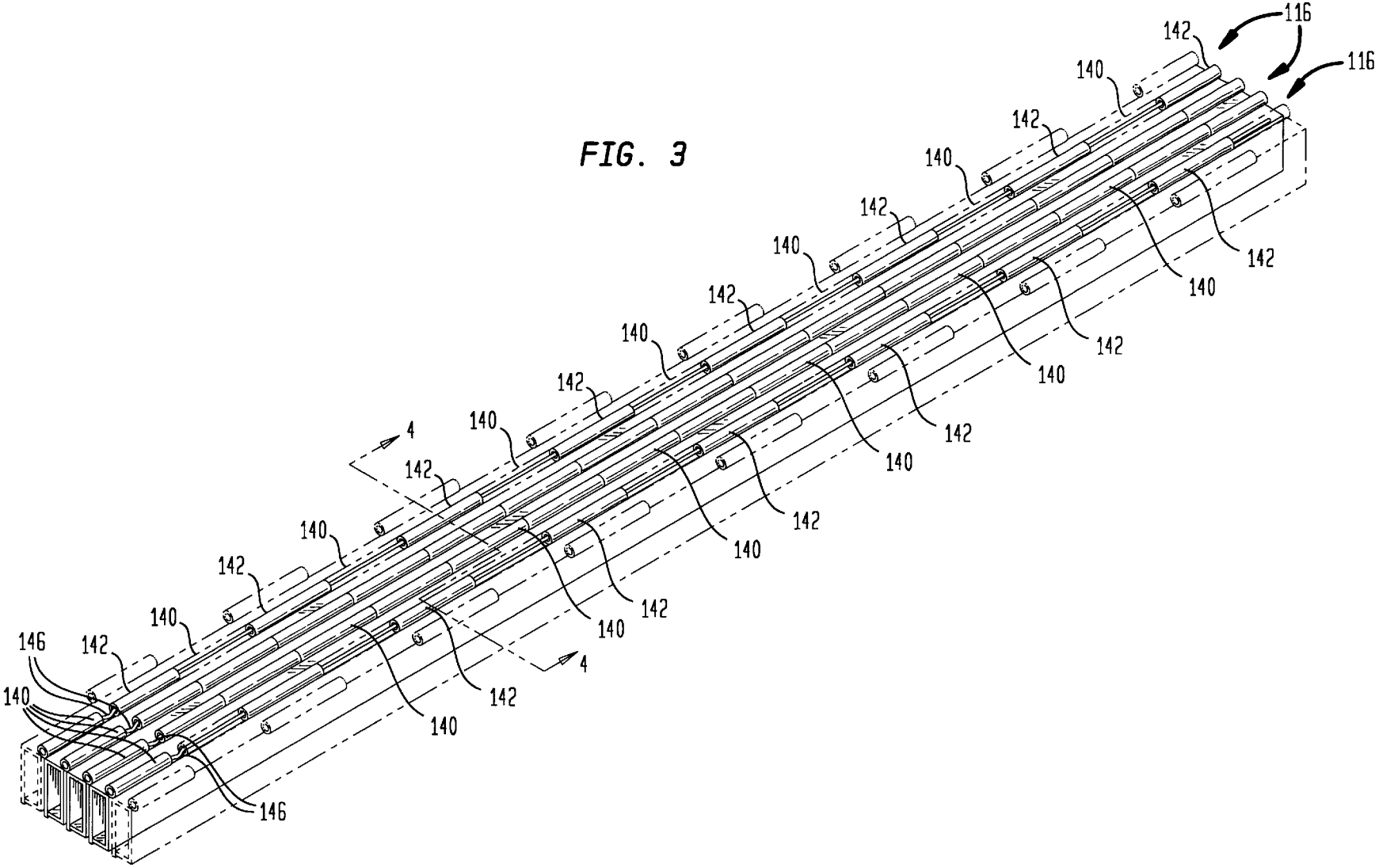
116
116
142
140
142
140
142
140

SAMPLE BOOK BINDING SYSTEM

BACKGROUND OF THE INVENTION

The present invention relates in general to sample books for generally flat type materials such as sample sheets which may support a variety of sample items, for example, wall covering samples, decorative fabric samples and the like, and to a method of making same. More particularly, the present invention is directed to a binding system for a sample book having an interlocking device which enables the assembly and disassembly of the binding system in a relatively simple and secure manner in order to accommodate any number of samples that are desired to be included within the sample book.

Sample books are used in the decorating and other industries for binding together into a single book a multitude of different samples of material, such as for example, wall paper, carpet samples, decorative fabrics and other wall coverings and decorative materials. Sample books are often used by customers for the examination and selection of wall and floor coverings for purchase. As a result, such sample books are generally quite bulky and often are very heavy as they must collect and bind together in a single book a large number of different samples or materials. It has therefore become desirable to be able to remove obsolete samples from the sample book to reduce size and weight or, in the alternative, to be able to conveniently add additional new samples as may be desired to bring the sample book up to date.

To this end, there are known a number of sample books which enable the removal and insertion of sample pages. For example, Stancato, U.S. Pat. No. 4,601,489 discloses a photo album binding system including a plurality of interconnecting spine components each supporting a plurality of spaced apart cylindrical shaped spine members. The spine members are formed into a pointed configuration at one end, the other end being formed into a cup configuration so as to be able to mechanically receive in an interfit relationship the pointed configuration from another spine member. The individual spinal components are rotationally interconnected by snapping the spine members together in an interdigitated manner thereby permitting rotational movement of the pages of the album. In this manner, Stancato provides the ability to interconnect as many spine members together as may be required for the desired album, while at the same time, allowing removal of the spine members if desired.

This configuration although possibly suitable for albums designed for home use, is not suitable for sample books which are commercially used and which may be used for displaying bulky and heavy items such as carpets and window treatment samples. In this regard, the excessive abuse and misuse by customers of sample books, including their being dropped, would most likely result in the spine members becoming damaged, thereby precluding their ability to maintain the assembled relationship of the sample book. It is most important that the sample book maintain its integrity so as to provide a relatively long service life despite the generally destructive and damaging environment in which it is used. In addition, the constant turning of the album pages, as well as their insertion and removal can cause wear of the pointed configuration of the spine members such that they no longer snap into place thereby losing their mechanical interfit, and therefore, losing the functionality of the album's intended purpose.

Hong, U.S. Pat. No. 4,896,900 discloses as known prior art a loose-leaf album binder formed from a plurality of rotatably connectable members each having a plurality of axially aligned seats alternatively formed along a pair of corresponding edges of adjacent pages. The seats are rotationally interconnected by the use of a wire inserted therethrough. See also Champagne, U.S. Pat. No. 4,949,997. However, as noted by Hong, the use of this conventional loose-leaf binder suffers from a number of disadvantages. For example, it is often difficult to insert the wires into the axially aligned seats as they may be curved and/or the seats may not be precisely aligned or manufactured. The ability to insert the wires becomes more difficult as the openings within the seats must provide a friction fit to prevent the wires from falling out during use.

To overcome these problems, Hong provides a plurality of members having a pillar at one end and an axially concave knuckle at the other end. A slit is formed on the outer wall of the concave knuckle so that a pillar may be inserted into the concave knuckle. The slit is shaped to have a restricted opening so as to maintain capture of the pillar of the member when in assembled relationship. The use of the pillars and slits results in Hong also having a number of disadvantages, such as those mentioned with respect to Stancato. In particular, the insertion and removal of the pillar within the slits of the members can cause the pillars to break thereby precluding use of the album page. In addition, the combination of a pillar and axially concave knuckle having a slit does not provide sufficient mechanical strength to sustain the abuse and misuse by customers who often simply tend to flip through and toss aside and/or drop the sample books.

There is therefore the continued need for an improved sample book which overcomes the above noted and other disadvantages of the prior art, and in particular, one which is capable of securing a plurality of sample sheets such as those having bulky samples to a plurality of sheet holding members which may readily be removed or assembled within the binder as desired by the user, while at the same time, being capable of withstanding the generally rigorous and abusive conditions to which sample books are generally subjected.

SUMMARY OF THE INVENTION

In accordance with one embodiment of the present invention there is described a binder for a sample book comprising a plurality of sheet holding means for attaching a sample sheet thereto, the sheet holding means including a plurality of linking segments each having an axial bore extending therethrough, a plurality of the linking segments of one of the sheet holding means arranged interdigitated with a plurality of the linking segments of an adjacent one of the sheet holding segments means whereby the axial bores of the interdigitated linking segments are in longitudinal alignment, at least one opening provided in the interdigitated linking segments, and connecting means slidably received within the aligned axial bores of the interdigitated linking segments for rotationally connecting the sheet holding means together in side-by-side relationship, the connecting means having at least one portion thereof received within the opening configured for interlocking the linking segments in interdigitated arrangement, the sheet holding means being separable from one another upon removal of connecting means by application of a sufficient force to enable passage of the configured portion through the axial bore of at least one of the linking segments.

In accordance with another embodiment of the present invention there is described a binder for a sample book comprising a plurality of sheet holding means for attaching a sample sheet thereto, linking means provided on the sheet holding means for rotationally joining the sheet holding means in side-by-side relationship, the linking means of one sheet holding means arranged interdigitated with the linking means on an adjacent sheet holding means, at least one opening provided in the interdigitated linking means, connecting means extending through the interdigitated linking means for rotationally connecting the sheet holding means together, and interlocking means provided on the connecting means arranged within the opening for maintaining the connecting means within the interdigitated linking means.

In accordance with another embodiment of the present invention there is described a sample book for sample sheets, the sample book comprising a cover member, a plurality of sheet holding members attached to the cover, the sheet holding members including linking segments each having an axial bore extending therethrough, a plurality of the linking segments of one sheet holding member arranged interdigitated with a plurality of the linking segments of an adjacent sheet holding member whereby the axial bores of the interdigitated linking segments are in longitudinal alignment, at least one opening provided in the interdigitated linking segments, and an elongated pintle slidably received within the aligned axial bores of the interdigitated linking segments for rotating connecting the sheet holding members together in side-by-side relationship, the pintle having at least one portion thereof received within the opening configured for interlocking the linking segments in interdigitated arrangement, the sheet holding members being separable from one another upon removal of the pintle by application of a sufficient force to enable passage of the configured portion through the axial bore of at least one of the linking segments, and a plurality of sample sheets attached to the sheet holding members.

In accordance with another embodiment of the present invention there is described a method of binding a plurality of sample sheets, the method comprising the steps of attaching a plurality of sample sheets to a plurality of sheet holding members, providing the sheet holding members with a plurality of linking segments each having an axial bore extending therethrough, interdigitating a plurality of the linking segments of one sheet holding member with a plurality of linking segments of an adjacent sheet holding member, arranging the axial bores of the interdigitated linking segments in longitudinal alignment, providing at least one opening in the interdigitated linking segments, providing an elongated pintle with at least one configured portion, rotationally connecting the sheet holding members together in side-by-side relationship by positioning the pintle within the aligned axial bores of the interdigitated linking segments, interlocking the linking segments by arranging the at least one configured portion within the opening, whereby the sheet holding members are separable from one another upon removal of the pintle by application of a sufficient force to enable passage of the configured portion through the axial bore of at least one of the linking segments.

In accordance with another embodiment of the present invention there is described a method of forming a binder for binding a plurality of sample sheet thereto, the method comprising the steps of providing a plurality of sheet holding members, providing the sheet holding members with a plurality of spaced apart linking segments each having an axial bore extending therethrough, arranging the sheet holding members in side-by-side relationship with the linking segments of one sheet holding member interdigitated with the linking segments of an adjacent sheet holding member, providing at least one opening in the interdigitated linking segments, rotationally connecting the sheet holding members together by inserting a pintle having a configured portion through the axial bores of the interdigitated linking segments, and interlocking the linking segments in interdigitated arranged by arranging the configured portion of the pintle within the opening.

BRIEF DESCRIPTION OF THE DRAWINGS

The above description, as well as further objects, features and advantages of the present invention will be more fully understood with reference to the following detailed description of a sample book binding system, when taken in conjunction with the accompanying drawings, wherein:

FIG. 3 is a perspective view illustrating a plurality of sheet holding members having their linking segments interdigitated so as to be rotationally interlocked by means of an elongated pintle;

DETAILED DESCRIPTION OF THE PREFERRED EMBODIMENTS

Figure 1:
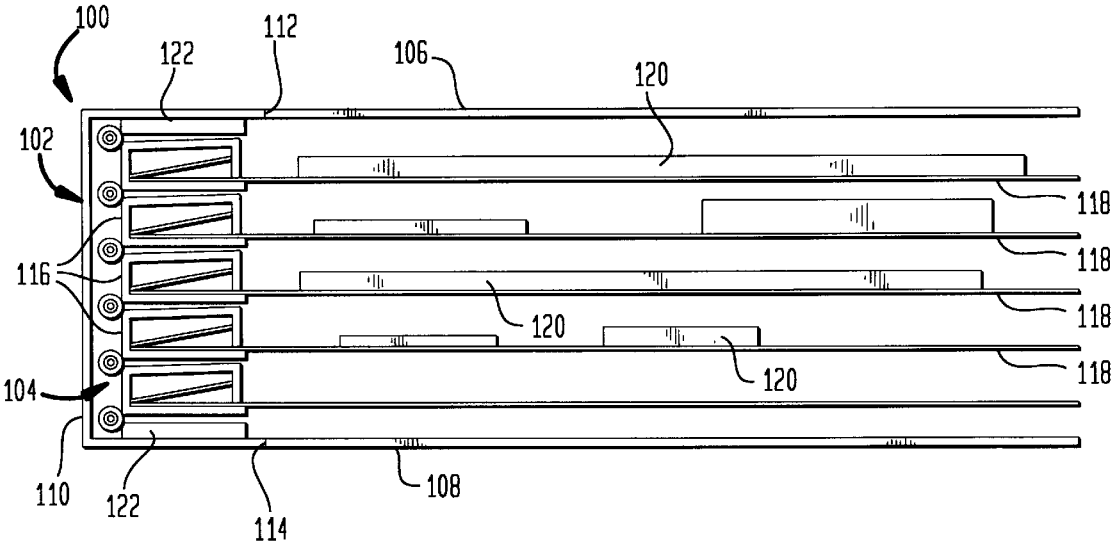
FIG. 1 is an end view of a sample book constructed in accordance with one embodiment of the present invention illustrating a binding system operatively securing a plurality of sample sheets in a turnable stack by means of a plurality of elongated sheet holding members.

In describing the preferred embodiments of the subject matter illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Referring to the drawings, wherein like reference numerals represent like elements, there is shown in FIG. 1 a sample book generally designated by reference numeral 100. The sample book 100 includes an optional cover 102 and a binding system 104. The optional cover includes substantially planar first and second cover sections 106, 108 joined together by means of a substantially planar spine section 110. The first and second cover sections 106, 108 are each hingedly connected to the spine section 110 along hinge lines 112, 114. In this manner, the first and second cover sections 106, 108 will form the top and bottom covers respectively of a finished covered sample book 100, while the spine section 110 will form the back covered edge of the sample book. Either of the first and second cover sections 106, 108 may be printed with relevant indicia and/or information regarding the nature and function of the sample book 100 as may be desired. It is to be understood that the cover 102 is an optional feature of the sample book 100 and may be omitted if desired.

The binding system 104 includes a plurality of sheet holding members 116 which are rotationally interlocked together in side-by-side relationship. Each of the sheet holding members releasably secures thereto, for example, a sample sheet 118 to which there is affixed one or more samples 120, for example, a carpet sample, a wall covering sample, a window treatment, etc. When it is desired to include a cover 102, the binding system 104 will include a pair of spaced apart cover attaching members 122.

Figures 2, 11:
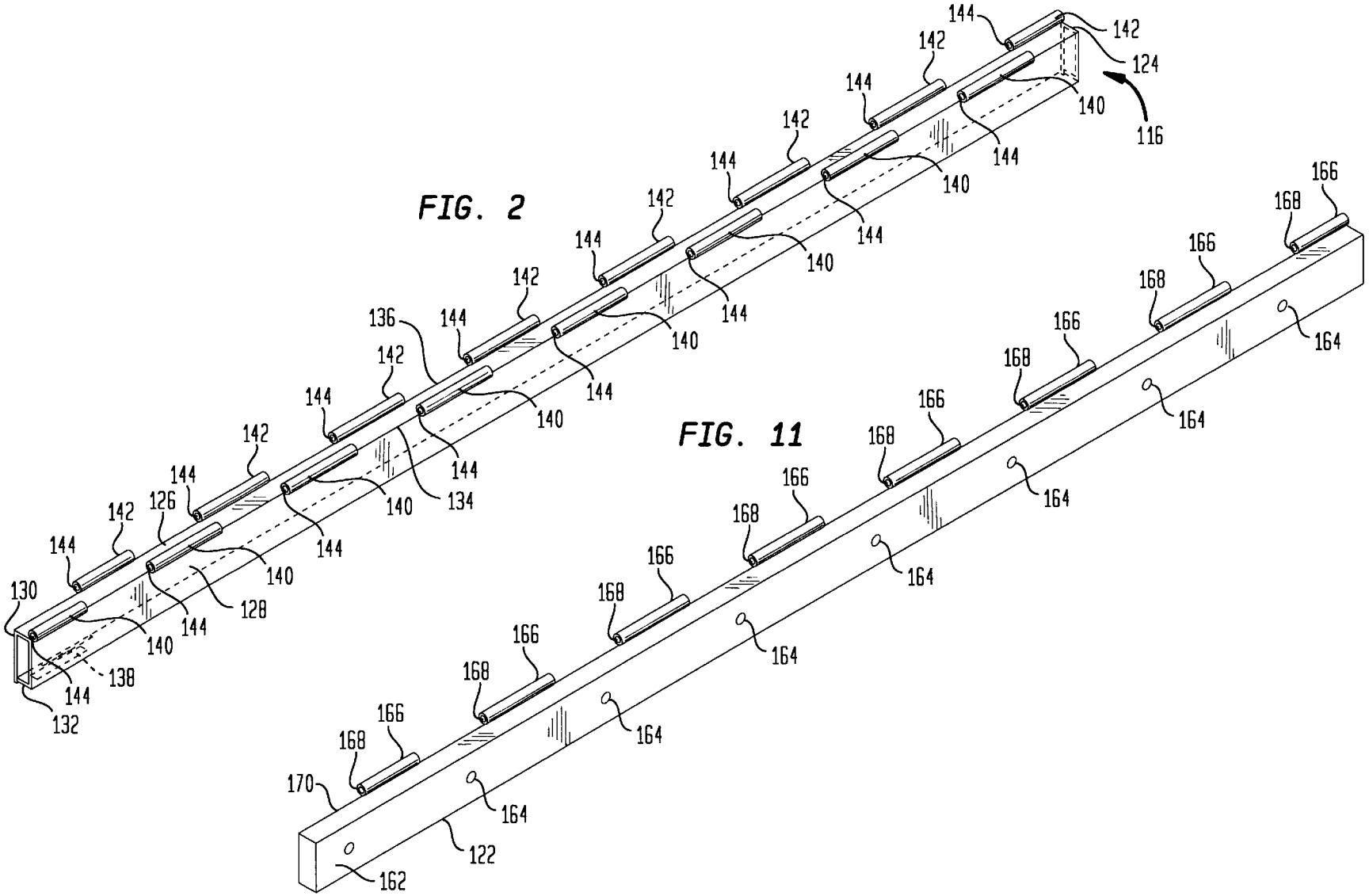
FIG. 2 is a perspective view illustrating the construction of the sheet holding member supporting a plurality of cylindrical shaped linking segments.
FIG. 11 is a perspective view illustrating an optional cover attaching member.

Referring to FIG. 2, each of the sheet holding members 116 is constructed from an elongated body 124 having a top wall 126, a pair of sidewalls 128, 130 and a bottom wall 132. The sidewalls 128, 130 are connected to the top wall 126 along side edges 134, 136, while the bottom wall 132 is only connected to sidewall 128. Optionally as shown, the sidewall 130 may have its free end terminating slightly below the bottom wall 132 by virtue of the sidewall 130 being slightly wider than sidewall 128. An elongated opening 138 is provided within the bottom wall 132 adjacent one end thereof. However, as will be understood hereinafter, a plurality of such openings 138 may be provided at different locations within the bottom wall. In this regard, the opening 138 is adapted to secure a sample sheet 118 to the sheet holding member 116 as to be described hereinafter.

Secured to or integrally formed with the side edges 134, 136 of the sheet holding member 116 are a plurality of spaced apart linking segments 140, 142. The linking segments are constructed as elongated cylindrical shaped segments each having an axial bore 144 extending therethrough. The linking segments 140, 142 are arranged longitudinally spaced apart along the side edges 134, 136, as well as being transversely staggered from each other. The sheet holding members 116 may be fabricated from suitable plastic material and the like.

Figure 4:
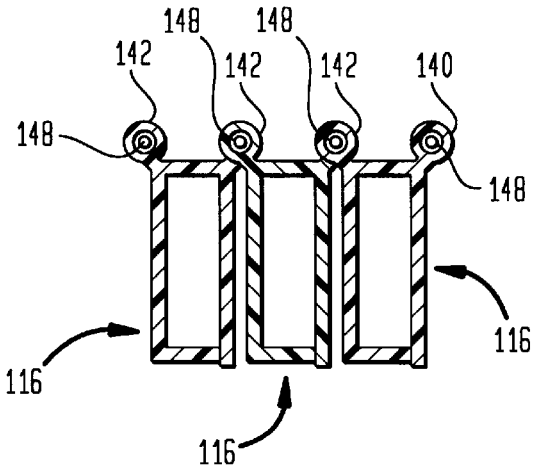
FIG. 4 is a cross-sectional view taken along Line 4—4 in FIG. 3.

Referring to FIGS. 3 and 4, a plurality of sheet holding members 116 are arranged in side-by-side relationship such that the linking segments 140 of one sheet holding member are interdigitated with the linking segments 142 of an adjacent sheet holding member. In this manner, the axial bores 144 of the interdigitated linking segments 140, 142 of adjacent sheet holding member 116 are arranged in longitudinal alignment. In this regard, the linking segments 140, 142 are sized so as to be positioned in abutting end-to-end relationship in parallel rows along the sheet holding members 116.

In accordance with one embodiment of the present invention, at least a pair of the interdigitated linking segments 140, 142 are sized so as to be spaced apart in their end-to-end relationship to provide an opening 146 therebetween. Preferably, the opening 146 is arranged adjacent one end of the sheet holding member 116. The plurality of sheet holding members 116 are rotationally interlocked by inserting a rod like pintle 148 through the longitudinally aligned axial bores 144 of the interdigitated linking segments 140, 142. In this manner, the pintle 148 functions to allow the sheet holding members 116 to rotate via the linking segments 140, 142 when in assembled relationship.

Figure 5A:
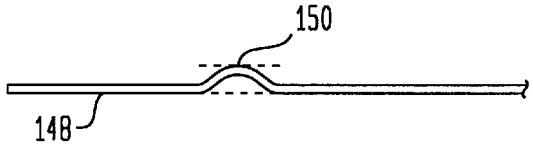
FIGS. 5A and 5B are side elevational views illustrating the pintle having a deformed section.
Figure 5B:
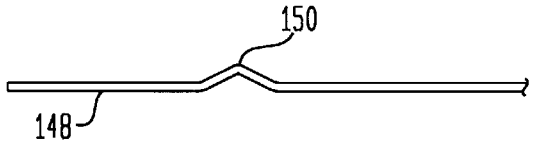

As shown in FIGS. 5A and 5B, the pintle 148 is constructed as an elongated rod-like member from a variety of materials, such as metals, e.g., steel, spring steel and the like, as well as plastic material. In the preferred embodiment, the diameter of the pintle 148 in relationship to the diameter of the axial bore 144 of the linking segments 140, 142 is such to provide a somewhat loose and free sliding fit therebetween. In this regard, the relative size of the pintle 148 with respect to the axial bores 144 will facilitate insertion within the linking segments 142, 144 regardless of whether there is perfect longitudinal alignment therebetween. This greatly facilitates the assembly of the binding system 100 in accordance with the present invention.

Figure 7:
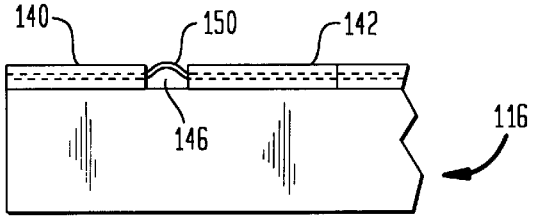
FIG. 7 is a side elevational view illustrating in enlarged detail the operative relationship of the deformed section of the pintle within an opening between a pair of adjacent linking segments.
Figure 8:
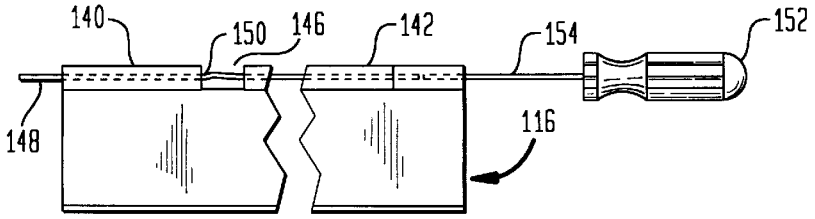
FIG. 8 is a side elevational view illustrating the insertion and/or removal of a pintle within the linking segments and the operative effect of the deformed section of the pintle.

In order to prevent the pintle 148 from inadvertently sliding out of its operative position within the linking segments 140, 142, the pintle is provided with a section 150 which may be formed, by way of example, as a deformed section of various different shapes from the remaining portion of the pintle. As illustrated in the example of FIG. 5B, the deformed section 150 has a v-shape, while in FIG. 5A a U-shape formed by bending, stamping or the like when the pintle is constructed of metal, and by casting, heat forming or the like when the pintle is constructed from plastic material. Regardless of the particular shape of the deformed section 150, the deformed section as more clearly shown in FIGS. 7 and 8, is received and captured within the opening 146 provided between a pair of adjacent interdigitated linking segments 140, 142. The deformed section 150 in the preferred embodiment is constructed so as to have an overall effective diameter, i.e., the distance between the dashed lines in FIG. 5B, greater than the diameter of the axial bore 144 of the adjacent interdigitated linking segments 140, 142. In this manner, deformed section 150 of the pintle 148 will prevent the inadvertent dislodging of the pintle from within the interdigitated linking segments 140, 142 during use and storage of the sample book 100. In essence, the deformed section 150 of the pintle 148 effectively locks the pintle in operative position to maintain the sheet holding members 116 in rotational interlocking arrangement.

Turning more specifically to FIGS. 7 and 8, the pintle 148 may be inserted through the axial bore 144 of the outermost linking segment 140 notwithstanding that deformed section 150 of the pintle has an effective diameter greater than that of the axial bore. In this regard, the pintle 148 is constructed such that the section 150 will deform or collapse upon application of, for example, sufficient longitudinal force to reduce the effective diameter of section 150 so as to enable its passage through the axial bore 144. This can be accomplished in a number of ways. For example, the pintle 148 can be constructed from suitable materials, such as metals and plastic materials which will deform or yield by flexing upon application of a sufficient force thereto. In this regard, the force applied to the section 150 as the pintle 148 is forced through the linking segment 140 will cause the section to deform or collapse into an effective diameter corresponding to that of the axial bore 144 thereby allowing its passage. Upon passing through the linking segment 140, the section 150 will return to its original effective diameter thereby precluding inadvertent dislodging of the pintle 148.

In an alternative arrangement, the diameter of the pintle 148 may be such so as to inherently provide the pintle and section 150 with sufficient resiliency and deformability to enable reduction of its effective diameter upon the application of a small force as the pintle is inserted through the linking segment 140. As previously described, the opening 146 is preferably arranged adjacent one end of the sheet holding member 116. As a result of this arrangement, it is required that section 150 of the pintle 148 be passed through only one linking segment 140 for insertion and removal. However, it is contemplated that the opening 146 be positioned at another location along the sheet holding member 116 whereby section 150 will pass through a plurality of linking segments 140, 142. In addition, it is also contemplated to provide more than one section 150 on the pintle 148 and a plurality of corresponding openings 146 if so desired.

Figure 6:
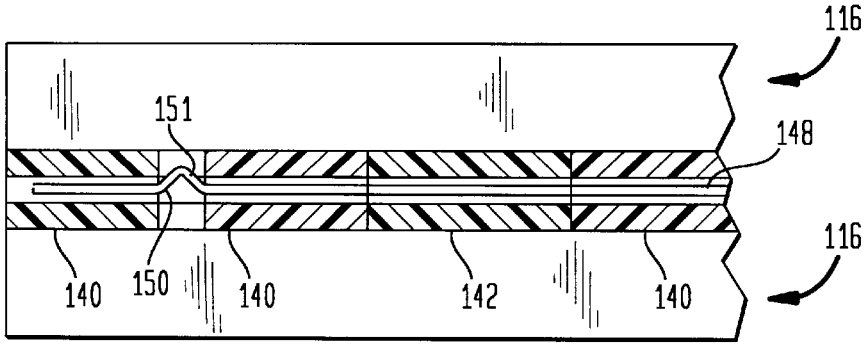
FIG. 6 is a partial cross-sectional view showing the operative relationship of the deformed section of the pintle with respect to the linking segments in accordance with another embodiment of the present invention.

In accordance with another embodiment of the present invention, an opening 151 may be provided in one or more of the linking segments 140, 142 as shown in FIG. 6, as opposed to or in addition to the openings 146 provided between the ends of adjacent linking segments. The opening 151 may be a complete removal of a section of one of the linking segments 140, 142 or only a partial break in the sidewall forming the linking segment. It is only required that the opening 151 be of sufficient size to receive or capture the deformed section 150 of an inserted pintle 148. In all other respects opening 151 functions in the same way as opening 146 to secure the pintle 148 in position within the linking segments 140, 142.

The pintle 148 may be inserted and/or removed from the linking segments 140, 142 by the use, for example, of a tool 152 having a rod-like member 154. The rod-like member 154 has a diameter slightly smaller than the axial bore 144 to enable sliding fit within the aligned linking segments 140, 142. As shown in FIG. 8, the rod-like member 154 is inserted within the free end of the last linking segment 142 so as to engage the end of the pintle 148. Upon application of a longitudinal force, the pintle 148 is displayed such that section 150 engages linking segment 140 about the axial bore 144 thereby deforming section 150. In addition, deformation of section 150 of the pintle 148 can be assisted by applying direct pressure thereto with opening 146 using, for example, the blade of a screwdriver and the like. As section 150 is reduced to an effective diameter corresponding to that of the axial bore 144, the pintle 148 will continue to slide longitudinally through the linking segments 140, 142 until the deformed section is free of the last linking segment. At this time, the pintle may be freely withdrawn from the linking segments 140, 142. In this manner, the sheet holding member 116 may be removed from the binding system 104, or using the reverse procedure, another sheet holding member may be attached to the binding system 104 as desired.

Figure 9:
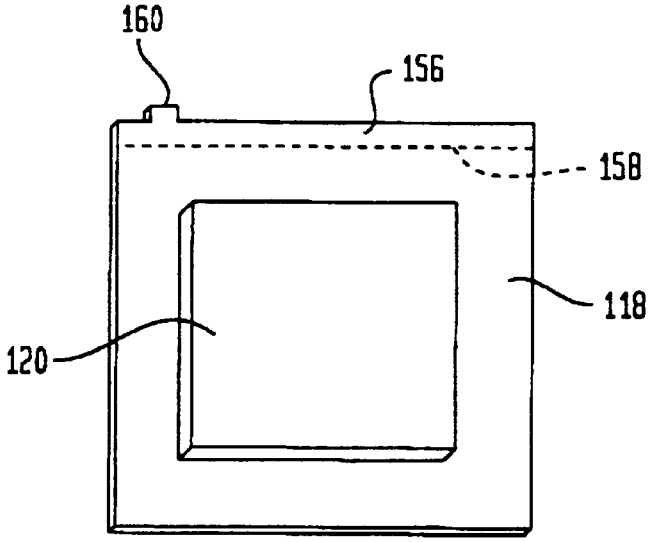
FIG. 9 is a top plan view illustrating a sample sheet having a sample secured thereto.

Turning to FIG. 9, there is illustrated a sample sheet 118 to which there is attached a sample 120. The sample sheet 118 is constructed from stiff paper board or other such suitable material for supporting a sample 120. The sample sheet 118 is generally rectangular in nature, having a marginal portion 156 defined from the remaining portion of the sheet by means of a fold line 158. A tab 160 extends outwardly from the edge of the marginal portion 156.

Figure 10:
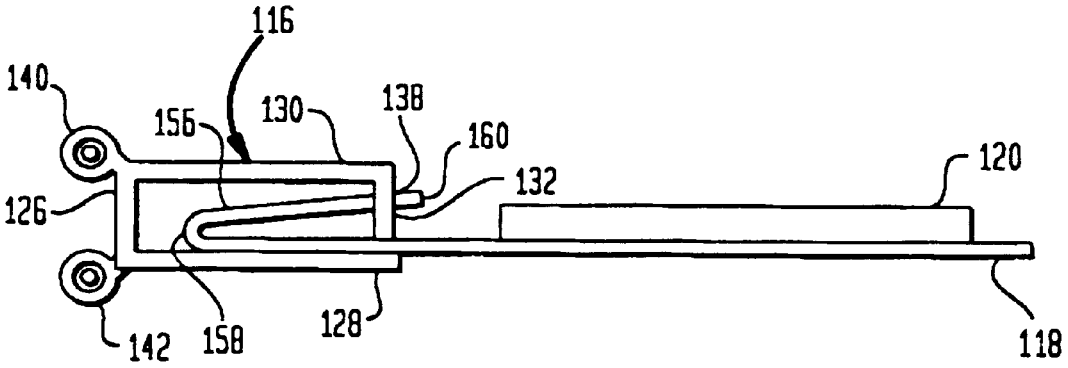
FIG. 10 is a side elevational view illustrating the sample sheet of FIG. 9 being releasably secured to a sheet holding member.

As illustrated in FIG. 10, the marginal portion 156 is folded over the adjacent portion of the sample sheet 118 about fold line 158. The folded over portion of the sample sheet 118 is inserted into the interior of the sheet holding member 116 through the narrow opening created between the free end of bottom wall 132 and sidewall 128. The tab 160 is positioned on the sample sheet 118 so as to align with the opening 138 within the bottom wall 132 of the sheet holding member 116. As a result, the tab 160 will protrude through the opening 138 so as to prevent the sample sheet 118 from sliding longitudinally within the sheet holding member 116. In addition, the folded over portion of the sample sheet 118 will prevent the sample sheet from being inadvertently released from the sheet holding member 116 during use.

As thus far described, the binding system 104 is operative for releasably retaining a plurality of sample sheets 118 in assembled position. In this regard, the binding system 104 may be expanded and decreased in size by the addition and removal of one or more sheet holding members 116 in the manner as thus far described. As previously noted, one may optionally attach a cover 102 to the binding system 104 by means of the cover attaching members 122.

As shown in FIGS. 1 and 11, the cover attaching members include an elongated flat member 162 having a plurality of spaced apart openings 164 extending therethrough. A plurality of spaced apart linking segments 166 each having an axial bore 168 extending therethrough are arranged in spaced apart relationship along an edge 170 of member 162. The linking segments 166 function in the same manner as thus far described with respect to linking segments 140, 142.

As shown in FIG. 1, a cover attaching member 122 is rotationally interlocked to the first and last sheet holding members 116 forming the binding system 102. In this regard, the linking segments 166 are interdigitated with the linking segments 140, 142 of the adjacent sheet holding member 116 with their axial bores 144, 168, arranged in axially alignment. A pintle 148 is inserted through the aligned axial bores 144, 168 of the interdigitated linking segments 142, 166 so as to rotationally interlock the cover attaching member 122 to a sheet holding member 166. The thus far assembled, binding system 102 is arranged within the cover 102 such that the linking segments 140, 142, 166 are positioned adjacent the spine section 110 and the cover attaching members 122 are arranged overlying the first and second cover sections 106, 108 between the hinge lines 112, 114 and the spine section. The cover attaching members 122 are secured to the first and second cover sections 106, 108 by means of rivets (not shown) passing through the openings 164 and through suitable aligned openings (not shown) within the first and second cover sections. Alternatively, the cover attaching members 122 may be secured by adhesive, staples, stitching or any other suitable means.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A binder for a sample book comprising a plurality of sheet holding means for attaching a sample sheet thereto, said sheet holding means including a plurality of linking segments each having an axial bore extending therethrough, a plurality of said linking segments of one of said sheet holding means arranged interdigitated with a plurality of said linking segments of an adjacent one of said sheet holding segments means whereby said axial bores of the interdigitated linking segments are in longitudinal alignment, at least one opening provided in the interdigitated linking segments, and connecting means slidably received within the aligned axial bores of the interdigitated linking segments for rotationally connecting said sheet holding means together in side-by-side relationship, said connecting means having at least one flexible portion thereof received within said opening configured into a first configuration for interlocking said linking segments in interdigitated arrangement, said sheet holding means being connectable to one another upon insertion of said connecting means by application of a sufficient force thereto to cause said configured portion to collapse from said first configuration into a second configuration enabling passage of said configured portion when in said second configuration through the axial bore of at least one of said linking segments, said sheet holding means being separable from one another upon removal of said connecting means by application of a sufficient force thereto to cause said configured portion to collapse from said first configuration into said second configuration enabling passage of said configured portion when in said second configuration through the axial bore of at least one of said linking segments.

2. The binder of claim 1, wherein said sheet holding means further includes gripping means for gripping a sample sheet.

3. The binder of claim 1, wherein said linking segments comprise a plurality of cylindrical shaped segments each having said axial bore extending therethrough.

4. The binder of claim 3, wherein a plurality of said segments are arranged in two spaced apart parallel rows on said sheet holding means, said segments within one row being spaced apart a sufficient distance to enable interdigitation with a plurality of segments from an adjacent sheet holding means.

5. The binder of claim 1, wherein said opening is formed between at least one pair of spaced apart interdigitated linking segments.

6. The binder of claim 1, wherein said configured portion of said connecting means comprises a deformed section thereof.

7. The binder of claim 6, wherein said deformed section has a v-shape or U-shape.

8. The binder of claim 1, wherein the effective diameter of said configured portion is greater than the diameter of said connecting means.

9. The binder of claim 8, wherein the effective diameter of said configured portion is greater than the diameter of said axial bore.

10. The binder of claim 1, wherein said opening is formed within a portion of at least one of said linking segments.

11. A binder for a sample book comprising a plurality of sheet holding means for attaching a sample sheet thereto, linking means provided on said sheet holding means for rotationally joining said sheet holding means in side-by-side relationship, said linking means of one sheet holding means arranged interdigitated with said linking means on an adjacent sheet holding means, at least one opening provided in the interdigitated linking means, connecting means extending through the interdigitated linking means for rotationally connecting said sheet holding means together, and flexible interlocking means having a first configuration provided on said connecting means arranged within said opening for maintaining said connecting means within the interdigitated linking means, said flexible interlocking means being collapsible into a second configuration upon application of a sufficient force thereto enabling said configured portion to pass through at least one of said linking means when in said second configuration for connecting and separating said sheet holding means to and from each other.

12. The binder of claim 11, wherein said linking means comprise a plurality of cylindrical shaped segments each having an axial bore extending therethrough, said opening formed within a portion of at least one of said linking means.

13. The binder of claim 12, wherein said connecting means comprises an elongated pintle.

14. The binder of claim 12, wherein said interlocking means comprises a deformed portion of said connecting means, said opening formed between at least one pair of spaced apart linking means.

15. The binder of claim 14, wherein the effective diameter of said deformed portion is greater than the diameter of said axial bore of said segments.

16. A sample book for sample sheets, said sample book comprising a cover member, a plurality of sheet holding members attached to said cover member, said sheet holding members including linking segments each having an axial bore extending therethrough, a plurality of said linking segments of one sheet holding member arranged interdigitated with a plurality of said linking segments of an adjacent sheet holding member whereby said axial bores of the interdigitated linking segments are in longitudinal alignment, at least one opening provided in the interdigitated linking segments, and an elongated pintle slidably received within the aligned axial bores of the interdigitated linking segments for rotating connecting said sheet holding members together in side-by-side relationship, said pintle having at least one flexible portion thereof received within said opening configured into a first configuration for interlocking said linking segments in interdigitated arrangement, said sheet holding members being connectable to one another upon insertion of said pintle by application of a sufficient force thereto to cause said configured portion to collapse from said first configuration into a second configuration enabling passage of said configured portion when in said second configuration through the axial bore of at least one of said linking segments, said sheet holding members being separable from one another upon removal of said pintle by application of a sufficient force thereto to cause said configured portion to collapse from said first configuration into said second configuration enabling passage of said configured portion when in said second configuration through the axial bore of at least one of said linking segments, and a plurality of sample sheets attached to said sheet holding members.

17. The sample book of claim 16, wherein said cover member includes first and second cover sections joined by a spine section.

18. The sample book of claim 16, wherein said sheet holding members further include gripping means for gripping a sample sheet.

19. The sample book of claim 16, wherein said linking segments comprise a plurality of cylindrical shaped segments.

20. The sample book of claim 16, wherein a plurality of said linking segments are arranged in two spaced apart parallel rows on said sheet holding members, said linking segments within one row being spaced apart a sufficient distance to enable interdigitation with a plurality of linking segments from an adjacent sheet holding member.

21. The sample book of claim 16, wherein said configured portion of said pintle comprises a deformed section thereof.

22. The sample book of claim 16, wherein said deformed section has a v-shape or U-shape.

23. The sample book of claim 16, wherein the effective diameter of said configured portion is greater than the diameter of said pintle.

24. The sample book of claim 16, wherein the effective diameter of said configured portion is greater than the diameter of said axial bore of said at least one of linking segments.

25. The sample book of claim 16, wherein said opening is formed within a portion of at least one of said linking segments.

26. The sample book of claim 16, wherein said opening is formed between at least one pair of spaced apart interdigitated linking segments.

27. A method of binding a plurality of sample sheets, said method comprising the steps of attaching a plurality of sample sheets to a plurality of sheet holding members, providing said sheet holding members with a plurality of linking segments each having an axial bore extending therethrough, interdigitating a plurality of said linking segments of one sheet holding member with a plurality of linking segments of an adjacent sheet holding member, arranging the axial bores of the interdigitated linking segments in longitudinal alignment, providing at least one opening in the interdigitated linking segments, providing an elongated pintle with at least one flexible configured portion having a first configuration, rotationally connecting said sheet holding members together in side-by-side relationship by positioning said pintle within the aligned axial bores of the interdigitated linking segments, interlocking said linking segments by arranging said at least one flexible configured portion within said opening, whereby said sheet holding members are connectable to and separable from one another upon insertion and removal of said pintle by application of a sufficient force thereto to cause said configured portion to collapse from said first configuration into a second configuration enabling passage of said configured portion when in said second configuration through the axial bore of at least one of said linking segments.

28. The method of claim 27, wherein the step of interdigitating comprises arranging said linking segments in two spaced apart parallel rows on said sheet holding members, said linking segments within one row being spaced apart a sufficient distance to enable interdigitation with a plurality of said linking segments from an adjacent sheet holding member.

29. The method of claim 27, further including the step of forming said configured portion into a v-shape or U-shape.

30. The method of claim 27, wherein the step of providing said elongated pintle comprises providing said pintle with an effective diameter of said configured portion that is greater than the diameter of said pintle.

31. The method of claim 30, wherein the effective diameter of said configured portion is greater than the diameter of said axial bore of said at least one of said linking segments.

32. The method of claim 30, wherein providing said opening comprises the step of arranging at least one pair of interdigitated linking segments in spaced apart relationship.

33. The method of claim 27, wherein the step of attaching comprises providing said sheet holding members with gripping means for gripping said sample sheets.

34. The method of claim 27, further including the step of providing said linking segments as cylindrical shaped segments each having said axial bore extending therethrough.

35. The method of claim 27, wherein providing said opening comprises the step of forming said opening within a portion of at least one of said linking segments.

36. A method of forming a binder for binding a plurality of sample sheet thereto, said method comprising the steps of providing a plurality of sheet holding members, providing said sheet holding members with a plurality of spaced apart linking segments each having an axial bore extending therethrough, arranging said sheet holding members in side-by-side relationship with said linking segments of one sheet holding member interdigitated with said linking segments of an adjacent sheet holding member, providing at least one opening in the interdigitated linking segments, rotationally connecting said sheet holding members together by inserting a pintle having a flexible configured portion through the axial bores of the interdigitated linking segments, said flexible configured portion having a first configuration collapsible into a second configuration upon application of a sufficient force thereto to enable passageway of said flexible configured portion when in said second configuration through at least one axial bore of the interdigitated liking segments and interlocking said linking segments in interdigitated arranged by arranging said configured portion of said pintle having said first configuration within said opening, whereby said sheet holding members are separable from one another upon removal of said pintle by application of a sufficient force thereto to cause said configured portion to collapse from said first configuration into said second configuration enabling passage of said configured portion when in said second configuration through the axial bore of at least one of said linking segments.

37. The method of claim 36, wherein providing said opening comprises the step of arranging at least one pair of interdigitated linking segments in spaced apart relationship.

38. The method of claim 36, further including the step of forming said configured portion as a v-shape or U-shape.

39. The method of claim 36, wherein the step of rotationally connecting comprises providing said pintle having a diameter smaller than the effective diameter of said configured portion.

40. The method of claim 39, wherein the effective diameter of said configured portion is greater than the diameter of said axial bore of said linking segments.

41. The method of claim 39, wherein said pintle comprises an elongated rod.

42. The method of claim 36, wherein providing said opening comprises the step of forming said opening within a portion of at least one of said linking segments.

43. The binder of claim 1, wherein said configured portion has an effective diameter and each of said connecting means and said axial bore has a diameter.

44. The binder of claim 11, wherein said deformed portion has an effective diameter and said axial bore has a diameter.

45. The sample book of claim 16, wherein said configured portion has an effective diameter and each of said pintle and said axial bore has a diameter.

46. The method of claim 27, wherein each of said pintle and said axial bore has diameter.

47. The method of claim 36, wherein said configured portion has an effective diameter and said axial bore has a diameter.

* * * * *

UNITED STATES PATENT AND TRADEMARK OFFICE

CERTIFICATE OF CORRECTION

PATENT NO. : 5,975,577

DATED : November 2, 1999

INVENTOR(S) : GARY S. GOTTDIENER

It is certified that error appears in the above-identified patent and that said Letters Patent is hereby corrected as shown below:

Column 3, line 60, "sheet" should read --sheets--.
Column 4, line 6, "arranged" should read --arrangement--.
Column 5, line 35, after "wall" insert --132--.
Column 5, line 67, "rod like" should read --rod-like--.
Column 6, line 11, "free sliding" should read --free-sliding--.
Column 9, line 37, "1" should read --43--.
Column 10, line 7, "14" should read --44--.
Column 10, line 61, "16" should read --45--.
Column 10, line 64, "16" should read --45--.
Column 11, line 41, "27" should read --46--.
Column 12, line 18, "liking" should read --linking--.
Column 12, line 20, "arranged" should read --arrangement--.
Column 12, line 55, after "has" insert --a--.

Signed and Sealed this

Fifteenth Day of August, 2000

*Attest:*

Q. TODD DICKINSON

*Attesting Officer*

*Director of Patents and Trademarks*